US008220092B2

(12) United States Patent
Schulze

(10) Patent No.: US 8,220,092 B2
(45) Date of Patent: Jul. 17, 2012

(54) WASHING AND RINSING METHOD FOR A WASHING MACHINE

(75) Inventor: Ingo Schulze, Panketal (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 924 days.

(21) Appl. No.: 10/560,182

(22) PCT Filed: Jun. 9, 2004

(86) PCT No.: PCT/EP2004/006255

§ 371 (c)(1),
(2), (4) Date: Feb. 11, 2008

(87) PCT Pub. No.: WO2004/111325

PCT Pub. Date: Dec. 23, 2004

(65) Prior Publication Data

US 2008/0134447 A1 Jun. 12, 2008

(30) Foreign Application Priority Data

Jun. 12, 2003 (DE) ..... 103 26 551

(51) Int. Cl.
*D06F 33/02* (2006.01)
*D06F 37/38* (2006.01)

(52) U.S. Cl. ..... 8/159; 68/12.04; 68/12.06; 68/12.23; 68/58

(58) Field of Classification Search ..... 68/12.04, 68/12.06, 12.12, 12.16, 12.23, 58, 140; 8/158, 8/159

See application file for complete search history.

(56) References Cited

U.S. PATENT DOCUMENTS

| | | | | |
|---|---|---|---|---|
| 5,335,524 | A * | 8/1994 | Sakane | 68/12.04 |
| 5,560,061 | A * | 10/1996 | Wentzlaff et al. | 8/159 |
| 5,870,905 | A * | 2/1999 | Imamura et al. | 68/12.04 |
| 2004/0226107 | A1 | 11/2004 | Rohl et al. | |

FOREIGN PATENT DOCUMENTS

| | | |
|---|---|---|
| EP | 0 318 761 | 6/1989 |
| EP | 0 373 063 | 6/1990 |
| EP | 0 618 323 | 10/1994 |
| EP | 0 657 576 | 6/1995 |
| EP | 0 742 307 | 11/1996 |
| EP | 0 781 881 | 7/1997 |

OTHER PUBLICATIONS

International Search Report PCT/EP2004/006255, Sep. 1, 2005.

* cited by examiner

*Primary Examiner* — Joseph L Perrin
(74) *Attorney, Agent, or Firm* — James E. Howard; Andre Pallapies

(57) ABSTRACT

A method to improve the cleansing effect on non-delicate washing which is to be washed in a washing machine comprising a washing drum. The washing drum is driven in at least one A phase (intensive wetting) and in at least one second B phase (high wash mechanics) within the washing and/or rinsing processes. Said phases are successive at least once during said washing and/or rinsing processes. In the A phase (intensive wetting), the washing drum accelerates in the first rotational direction (+) up to a rotational speed n1 which is significantly greater than the applicational rotational speed and in the other rotational direction (−) up to a second rotational speed n2 which is significantly less than the applicational speed. In the B phase (high wash mechanics), the washing drum accelerates in both rotational directions up to rotational speeds whereat the individual items of washing are highly spun and are rubbed against each other.

22 Claims, 4 Drawing Sheets n = 25 to 40 1/min n = 50 to 60 1/min n = about 100 1/min n = 25 to 40 1/min n = 50 to 60 1/min n = about 100 1/min n = about 150 1/min n = 25 to 40 1/min

WASHING AND RINSING METHOD FOR A WASHING MACHINE

The invention starts from a method for improving the cleansing effect on non-delicate washing which is to be washed in a washing machine comprising a laundry drum which is driven intermittently during the washing and rinsing process in alternating directions of rotation, wherein in one phase the laundry drum is accelerated in one direction of rotation to a first rotational speed significantly above the applicational rotational speed, so-called washing-spinning, and in the other direction of rotation to a second rotational speed significantly below the applicational rotational speed. The applicational rotational speed is that speed at which the items of laundry just begin to adhere to the drum wall as a result of the induced centrifugal force.

Known from EP 0 781 881 A 1 is a method for washing machines which, in order to improve the washing effect, especially for faster wetting of the laundry, has phases during the washing and/or rinsing process during which the laundry drum is operated intermittently and reversingly at low and moderate speeds. During single such rotary movements the laundry drum is briefly brought to an average spinning speed. The acceleration of the laundry drum to the spinning speed is only allowed in a single direction of rotation during run down. As a result of these spinning phases the laundry is pressed strongly against the drum jacket especially when the laundry drum is fully loaded so that after such a spinning phase the laundry is redistributed by so-called drag ribs affixed to the wall of the laundry drum during the rotation phases at low and/or medium speed. A disadvantage with this method is that the speeds of the spinning phases are so high that after such a spinning section the laundry remains adhered to the drum wall for a while and must only be released from the drum wall during the following rotation phases. In this method, this release of the laundry is substantially brought about by the washing solution present in the laundry drum whereby however, no regrouping of items of laundry lying on the drum wall from outside into the interior of a laundry batch is achieved. This has a disadvantageous effect on the uniformity of the washing action inside a batch of washing.

BACKGROUND OF THE INVENTION

Such a method is known from EP 0 618 323 A1. In this method, during the washing and/or rinsing operation the textiles should absorb water at a speed significantly below the applicational rotational speed which is then expelled from the textiles again at a speed significantly above the applicational rotational speed. The speed and direction of rotation is selected for a scoop device which is provided such that this scoop device additionally assists the water absorption of the textiles. Thus, in this known method good wetting of the laundry is achieved. A weakness of this method has an effect especially with large laundry loads. In this case, only weak wash mechanics are exerted on the items of laundry. When the laundry drum is operated at speeds significantly below the applicational rotational speed, the laundry executes a so-called rolling movement. In the known method the wash mechanics, consisting of compression and friction between the individual items of laundry is reduced considerably during operation at speeds significantly below the applicational rotational speed. When the laundry drum is driven above the applicational rotational speed, this is even completely absent since the individual items of laundry adhere firmly to the wall of the laundry drum.

Such or similar methods are suitable for washing especially delicate or handwash-only textiles as a result of the process-dependent reduced wash mechanics.

A further method is known from WO 03/010380 A1, which comprises several phases in which the laundry drum of a washing machine is driven at respectively different speeds and/or speed sequences during the washing and rinsing process. Within these phases the laundry drum is only operated intermittently at a spinning speed. As in the aforesaid methods no specific redistribution of exterior items of laundry of a batch of laundry into the interior area of the same is sufficiently brought about in this method, especially when the laundry drum is fully loaded.

A method for intensive wetting of laundry is also known from DE 37 41 177 A1. The process sequence described therein reveals a weakness during the redistribution of items of laundry especially large laundry loads, that is, the specific rearrangement of interior items into the outer area of the laundry batch and conversely during the washing and/or spinning process.

In the known method, reduced wash mechanics is exerted on the laundry to be washed at the expense of an improved laundry wetting. Especially in the case of non-delicate laundry too little cleansing effect is achieved as a result of the reduced wash mechanics. Thus no optimal washing result is achieved. In addition, in the methods described hereinbefore, the laundry is not sufficiently well redistributed when the laundry loads are large and very large. For example, the interior portions of the laundry inside the laundry drum do not reach the outer edge of the drum. Thus, very different mechanics dependent on their respective position is exerted on the individual items of laundry. Within a batch of laundry a very different washing result is thus obtained for interior and exterior items of laundry. In addition, exterior items of laundry frequently clump together as a result of their intensive local removal of water. This effect again results in a reduction of the wash mechanics of individual items of laundry and a non-uniform washing result.

SUMMARY OF THE INVENTION

It is the object of the invention to provide an operating mode during the washing and/or rinsing process for the method described initially wherein high wash mechanics is retained to clean non-delicate laundry and good redistribution of the laundry takes place especially with large loads. In addition, the aim is thus to achieve an improvement in the uniform washing effect of a laundry batch and to reduce the consumption of water, washing agent and energy.

This object is solved according to the invention by the fact that within the washing and/or rinsing process the laundry drum is driven in at least one further phase "intensive wetting" and in at least one further phase "high wash mechanics". These phases take place successively at least once within the washing and/or rinsing process. In the "intensive wetting" phase the laundry drum is accelerated in one direction of rotation to a speed significantly above the applicational rotational speed and in the other direction of rotation to a second speed significantly below the applicational rotational speed. In the "high wash mechanics" phase the laundry drum is accelerated in both directions of rotation to speeds at which the individual items of laundry are strongly compacted and rubbed vigorously against one another.

BRIEF DESCRIPTION OF THE DRAWINGS

The advantages of the invention, further embodiment of the invention, the method according to the invention and a washing machine for carrying out the method are described in detail with reference to the sequence examples and exemplary embodiments shown in the drawings. In the figures.

a) at about 35 l/min b) at about 50 l/min c) at about 100 l/min,

FIG. 4 is a schematic diagram of the laundry movement of a batch of laundry of a large load at different drum speeds:

a) at about 35 l/min b) at about 50 l/min c) at about 100 l/min,

FIG. 5 is a schematic diagram of the laundry movement during the redistribution according to the invention of a batch of laundry of a large load:

a) drum speed about 150 l/min b) turning the drum in the opposite direction at about 35 l/min.

DETAILED DESCRIPTION OF THE EXEMPLARY EMBODIMENTS OF THE PRESENT INVENTION

Figure 3A:
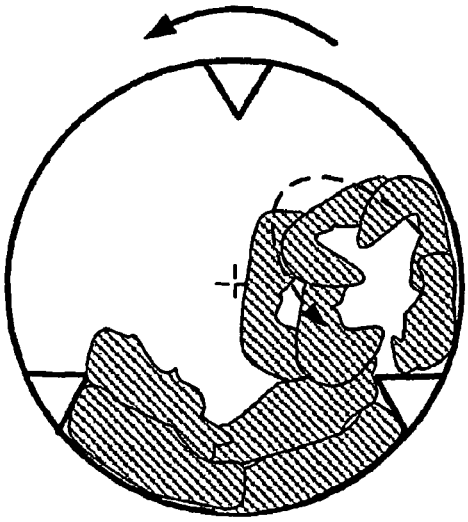

In order to intensify the wetting of the laundry with soap solution, in the method according to EP 0 618 323 A1 the laundry drum is driven during the washing and/or rinsing process in the respectively opposite directions of rotation at different rotational speeds. During one section in which the drum is driven at a speed significantly below the applicational rotational speed, the items of laundry absorb soap solution. In a second section in which the laundry drum is driven significantly above the applicational rotational speed, the soap solution is expelled from the items of laundry again. The released soap solution collects in the soap solution container and at the same time the level of the free soap solution in the container rises. The level thereby increased favours renewed absorption of water or soap solution by the laundry during the subsequent low-speed (e.g. 25 to 40 l/min) rotation of the drum. This speed (scoop speed) is optimised for washing appliances whose laundry drums are equipped with scoop devices. During scooping of the free soap solution, no large laundry mechanics is achieved since the drum speed is too low for this. During the revolution of the drum at a scoop speed, the laundry executes a rolling movement as is shown in FIG. 3*a* for a half-fully laden laundry drum. Non-delicate textiles can be washed with significantly higher wash mechanics than that acting during the "scooping" described above. Especially in the case of non-delicate textiles, no adequate washing and rinsing performance is achieved despite the good wetting of the textile. Thus, either programme running times must be increased or more washing agent must be used to compensate for the lack of washing performance.

Figure 3B:
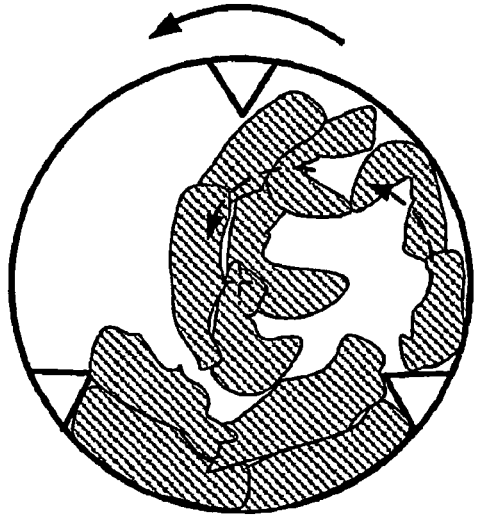

In contrast to the known method, in the method according to the invention the washing and/or spinning process comprises at least one phase (A) of intensive wetting, a phase during which the textile absorbs soap solution and releases it again, and also a phase (B) of high wash mechanics, e.g. drum speed 50 l/min. Phase (B) is characterised in that during rotation of the drum the items of laundry are raised so far that they are then returned to the bottom of the drum again as a result of acceleration due to gravity. This movement sequence of the laundry inside a half fully-loaded laundry drum is shown in FIG. 3*b*. During this process significantly more mechanics is exerted on the textile than during a rolling movement e.g. during the "scooping" described above. The laundry drum is alternately driven in each direction, that is in so-called reversing operation. The duration and the sequence of the intensive wetting phase, the operation of the laundry drum significantly above and significantly below the applicational rotational speed, and the duration and sequence of the high wash mechanics phase are selected so that the washing and rinsing performance is increased so far that a short programme running time and/or a reduced usage of washing agent is achieved.

Figure 4A:
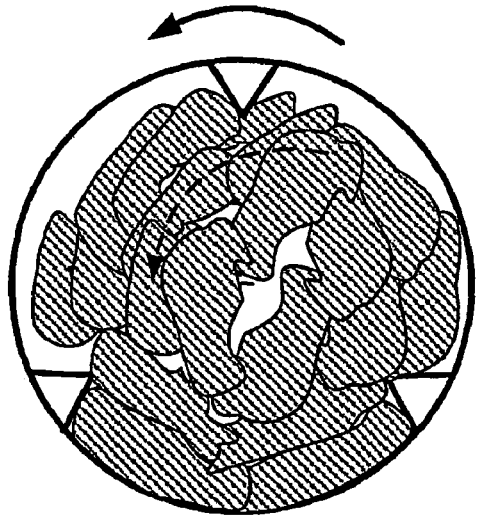
Figure 4B:
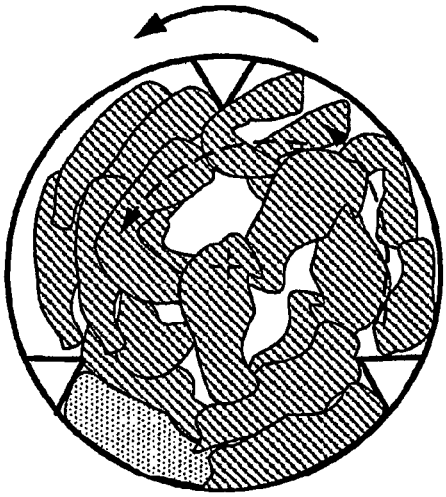
Figure 4C:
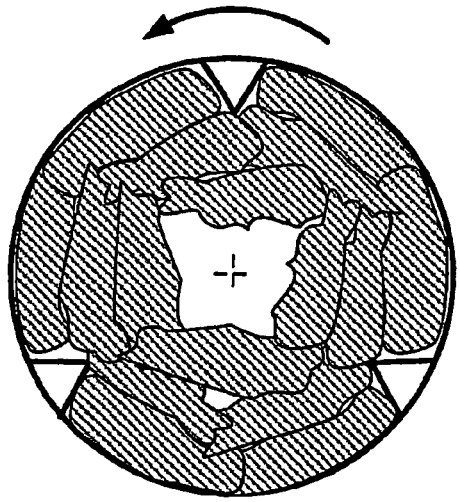

During reversing operation of a half fully-loaded laundry drum a certain regrouping of the laundry is effected. The raising of the laundry is assisted by so-called entrainers affixed to the drum. An entrainer can be constituted by a partially inwardly pulled drum jacket and also by an approximately triangularly profiled plastic part affixed to the drum jacket. Entrainers have a symmetrical or asymmetrical cross-section. Laundry drums fitted with asymmetrical entrainers are frequently driven in reversing mode at a different speed for each direction of rotation (e.g. 50 and 60 l/min). In a fully loaded laundry drum there is not sufficient free space inside the drum in which the laundry regroups in reversing operation. The operation of a fully loaded laundry drum during "scooping" is shown in FIG. 4*a* and during the high wash mechanics phase in FIG. 4*b*. In contrast to operation with a half fully loaded laundry drum, the individual items of laundry impede each other in their movement so that during the scooping operation and the high wash mechanics phase the laundry no longer regroups.

Figure 3C:
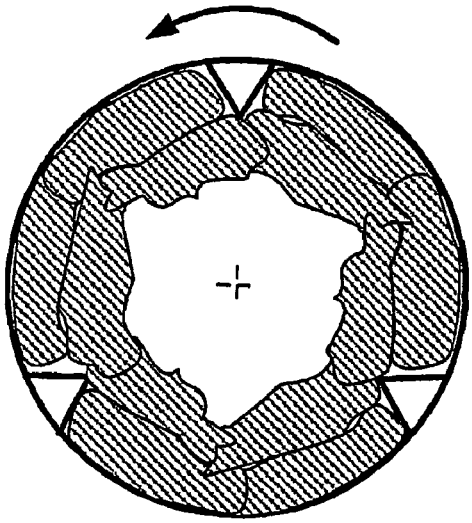

If the speed of the laundry drum is significantly above the applicational rotational speed and at the same time significantly below the resonance speed, especially with large laundry loads this speed is not sufficient to severely compress the laundry batch. That is to say, a relatively weak force is exerted on the interior items of laundry and the removal of moisture from these textiles will thus be less than in the case of the exterior textiles. For explanation, the compression of the laundry in a laundry drum driven at a speed significantly below resonance (e.g. 100 l/min) is shown in FIG. 3*c* for a half load and in FIG. 4*c* for a full load. Furthermore, the space left free in the fully loaded laundry drum is so small that no redistribution of items of laundry from inside to outside can take place. During the operating phases of intensive wetting and high wash mechanics no sufficient redistribution of laundry is achieved in a fully loaded laundry drum. The significantly reduced redistribution of the laundry in the drum has the result that the laundry batch is non-uniformly wetted and mechanically treated as a result of which the textiles in this batch of laundry are non-uniformly cleaned.

Figure 5A:
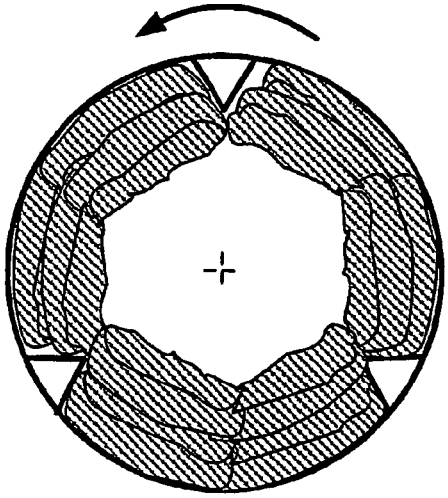
Figure 5B:
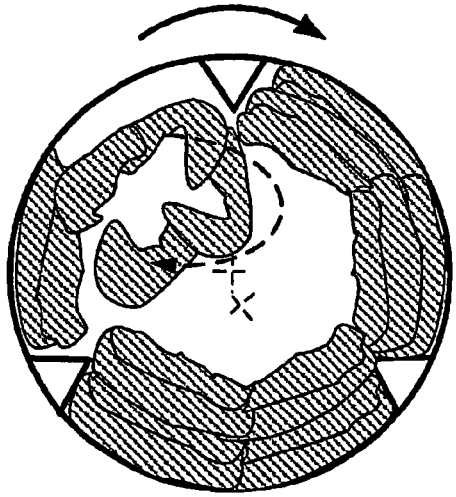

In an advantageous further development of the method according to the invention, a significantly higher speed (e.g. 150 l/min) is selected for the "wash-spinning" in order to compress the batch of laundry significantly better, as shown in FIG. 5*a*. In addition, a larger free area in the drum space is also provided as a result. As a result of the subsequent rotation of the laundry drum in the opposite direction, the exterior falling items of laundry roll into the inner area. This rolling process of the items of laundry is illustrated schematically in FIG. 5*b* at a drum speed of 35 l/min. The turning of the laundry drum in the opposite direction advantageously supports the rolling of the laundry into the interior of the laundry batch. Furthermore, it is desirable to restart directly after the drum has come to rest in order to counteract uncontrolled collapse of the laundry without further regrouping.

In order to avoid overstressing of the drive or the soap-solution container assembly, in an advantageous embodiment of the invention, the developing imbalance is monitored especially during the wash-spin section and when a predetermined limiting value is exceeded, the wash-spin operation is interrupted. Means for determining the soap-solution container vibration path, the motor current, torque, the speed or its time derivatives are suitable, for example, for determining the imbalance.

During the wash-spin operation, dipping of the inner drum into the soap solution located freely in the soap-solution container should be avoided to prevent any additional foam formation. A means for monitoring the foam is advantageously used and when a predetermined limiting value is exceeded, the wash-spin operation is interrupted. Means for determining the hydrostatic pressure, the motor current, torque, the speed or its time derivatives are suitable, for example, for determining the foam located in the soap-solution container. If the monitoring means is suitably selected, e.g. a device for monitoring engine speed, imbalance and foam monitoring can advantageously be combined.

As has already been addressed in the previous reasoning, the methods for rearrangement of laundry are highly dependent on the loading quantity. In addition to the quantity, the absorbency and the type of textile should also be taken into account when designing the process. Depending on the use, a user of a washing appliance inserts a broad spectrum of different batches of laundry and quantities in washing appliances. Thus, means for determining the type and/or quantity of laundry are advantageously used in order to set the speeds (n1 to n3), section times ((Δt1 to Δt6) and the durations (ΔtA, ΔtB) and sequence of the intensive wetting and high wash mechanics phases (A and B). Force or distance sensors integrated in the washing appliance can be used, for example, as suitable means for determining the laundry weight. These sensors are arranged in the appliance or on the spring-mounted vibration system (soap-solution container assembly) such that a change in the known weight of the vibration system or the known rest position can be determined by the additional weight of the laundry. The quantity, type and absorbency of the textiles to be washed can also be determined from a determination of the soap solution absorbed by the laundry (e.g. using a flow or pressure sensor) and from the time behaviour relating thereto.

By their programme selection (e.g. boil wash, easy-care, wool) the user of the washing machine specifies how sensitive are the textiles to be washed. It has proved to be particularly advantageous to implement the drum speed (n1 to n3), section times ((Δt1 to Δt6) and the durations (ΔtA, ΔtB) and sequence of the "intensive wetting" (A) and "high wash mechanics" (B) phases depending on the choice of programme to adapt the wash mechanics to the sensitivity of the textiles.

Figure 1:
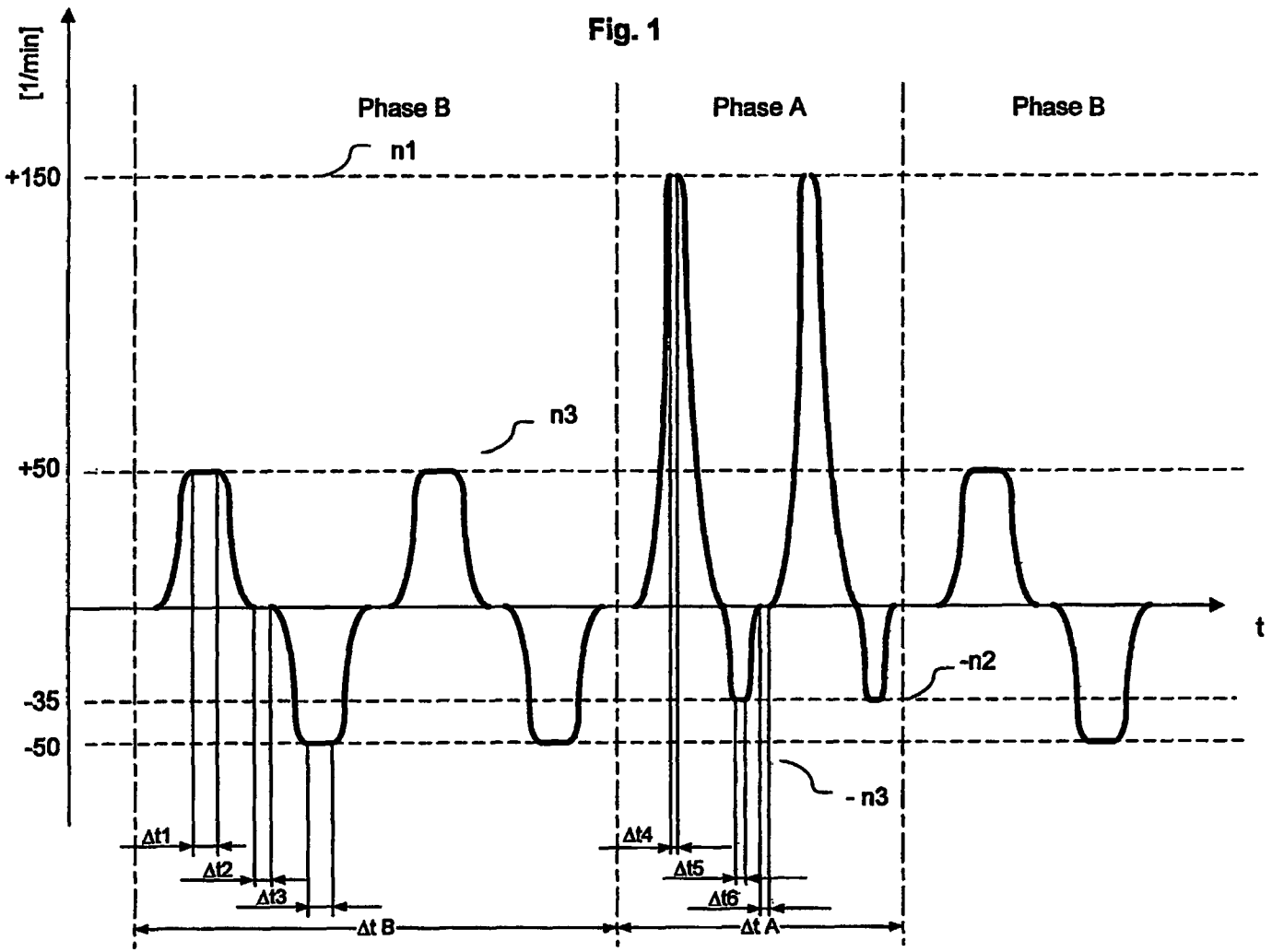
FIG. 1 is a rotational speed diagram for a washing and/or rinsing cycle configured according to the invention.

In the example shown in FIG. 1 the drum, which has a diameter of 470 mm, is gently accelerated clockwise to a speed (n3) of +50 l/min, remains at this speed for a duration Δt1 and is then returned to a speed of 0 l/min. After a stoppage time Δt2, the process is repeated with the drum rotating anti-clockwise. The residence time Δt3 during anti-clockwise rotation can differ from the corresponding residence time Δt1 of the clockwise rotation. This reversing process is repeated for the duration ΔtB of the high wash mechanics phase (B). Following this phase, the drum is gently accelerated clockwise to a speed (n1) of +150 l/min, remains for a duration Δt4 at this speed and is then returned to a speed 0 before being transferred directly to the anticlockwise phase at a speed (n2) of, for example, 35 l/min for the duration Δt5. After a stoppage time Δt6, the sequence is repeated until the duration ΔtA of the intensive wetting phase (A) is reached. A high wash mechanics phase (B) is then implemented. The specified time duration (Δt1 to Δt6, ΔtA and ΔtB) can be varied in any possible combination and in extreme cases can individually or all be zero.

Figure 2:
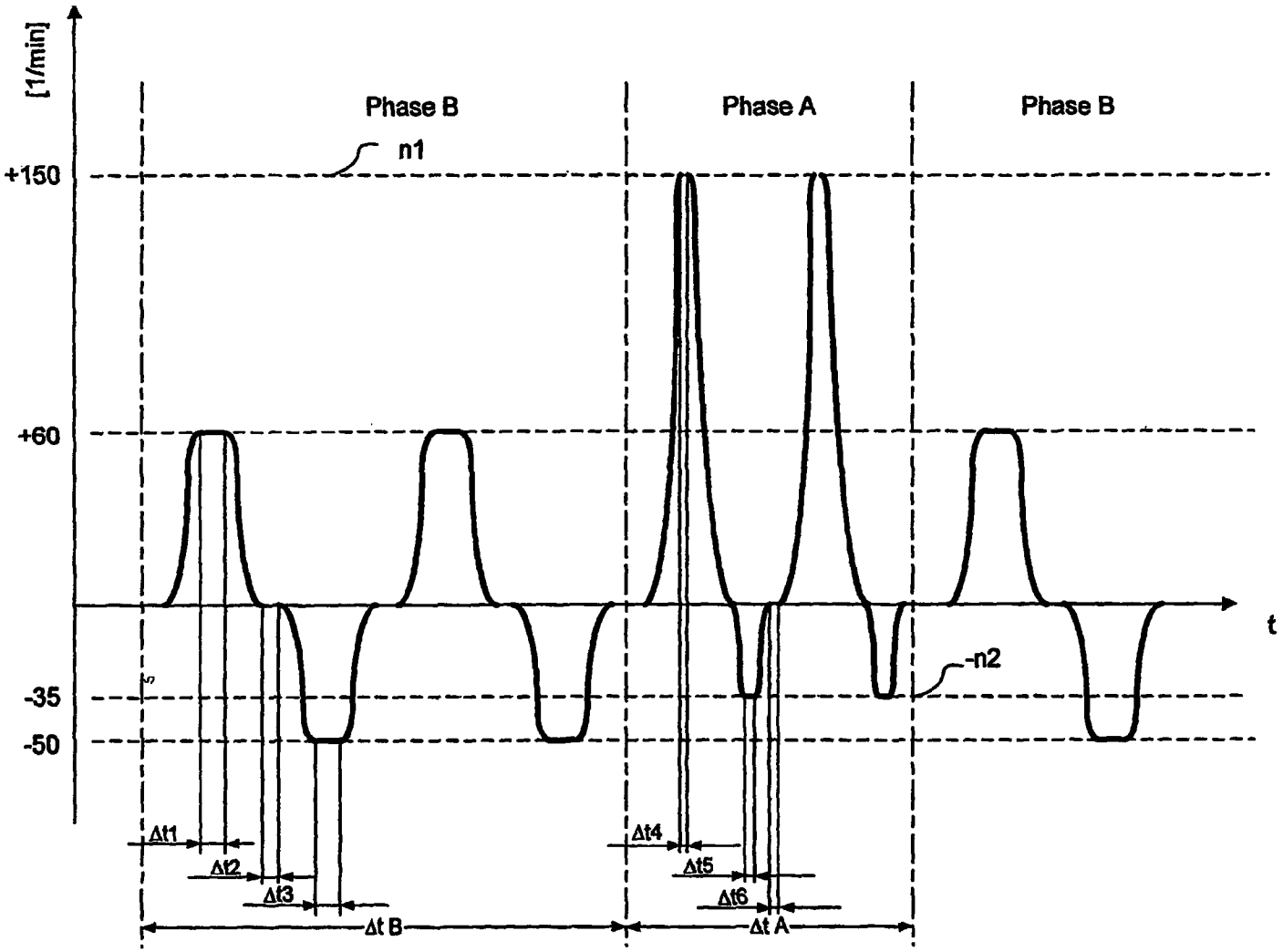
FIG. 2 is a further example of a washing and/or rinsing cycle shown using a rotational speed diagram and FIG. 3 is a schematic diagram of the laundry movement of a batch of laundry of an average load at different drum speeds.

Compared with FIG. 1, FIG. 2 shows a slightly different speed profile for the high wash mechanics phase (B). In this case, the clockwise and anticlockwise speeds differ, for example matched to asymmetrical entrainers.

The specified speeds nl, n2 and n3 can be freely selected within the limits specified herein. In order to achieve optimum effects, fixed machine parameters must also be taken into account for the choice of speed, which are obtained from the dimensions of the laundry drum, its flooding holes, the entrainers, the scooping device and the resonance speed. The radius of the laundry drum is especially crucial when selecting the speed since the radius fundamentally determines the applicational rotational speed. Thus, the advantageous nominal values of the speeds are predefined by predefining the circumferential speed of the laundry drum. For example, the circumferential speed of the laundry drum at the speed (n3) for high washing mechanics can lie in the interval of 1.1 to 1.6 m/s. The nominal value of the first speed (n1) can be selected so that the items of laundry lying on the drum jacket can fall back to the interior of the drum on reducing the speed and the nominal value of the second speed (n2) can have a value at which the falling items of laundry execute a rolling movement in the drum area. The circumferential speed of the laundry drum at the first speed (n1) can be approximately 3.7 m/s and at the second speed (n2) less than 1.0 m/s.

A washing machine comprising a speed control device for the drive motor of the laundry drum, and a washing machine comprising means (e.g., a speed control device) for controlling the drive motor of the laundry drum based on a circumferential speed in m/s of the laundry drum, and generating and sending control signals to the drive motor, are provided according to the invention for application of the method. The speed control device can generate control signals for the drive motor such that in the washing and/or rinsing process the laundry drum is intermittently driven in alternating directions of rotation at respectively different speeds in at least one intensive wetting phase (A) and at least one high wash mechanics phase (B). In addition to the speed control device, the washing machine can also be fitted with further control devices such as, for example, control electronics or power electronics. These control devices are interconnected by means of data or bus lines. For example, a control command or a control command sequence can be generated by power and/or control electronics and transmitted to the speed control device via the data or bus line.

This control command or control command sequence has the effect that the speed control device can generate a control signal for the drive motor such that the laundry drum is driven in the washing and/or rinsing process in at least one intense wetting phase (A) and at least one high wash mechanics phase (B).

Variable values, such as load quantity, type of laundry, wash programme, laundry imbalance and foam formation can advantageously also be taken into account and influence the choice of speeds and the residence times if the washing machine contains the devices described above for determining and evaluating the variable values. The speed control device is configured such that the formation of control signals by the speed control device for the drive motor is dependent on these variable values. For this purpose the devices, e.g.

sensors, for determining the variable values are either connected directly to the speed control device or indirectly by means of data or bus lines.

The explanations put forward above disclose a method and means for implementing the method which bring about a uniform washing effect very close to the optimum and within a laundry batch and a reduction in the water, washing agent and energy consumption is achieved.

The invention claimed is:

1. A method for improving the cleansing effect on non-delicate washing which is to be washed in a washing machine comprising a laundry drum, a drive motor intermittently driving the laundry drum during a washing and rinsing process in alternating directions of rotation, and a speed control device in communication with and controlling the drive motor of the laundry drum, the method comprising:

detecting a circumferential speed in m/s of the laundry drum using a speed sensor;

controlling, by the speed control device, the drive motor of the laundry drum based on the circumferential speed in m/s of the laundry drum detected by the speed sensor, the controlling including selecting a first phase during the washing and rinsing process and intermittently generating and sending:

a first control signal to the drive motor such that the drive motor, based on the first control signal received from the speed control device, accelerates the laundry drum in a first direction of rotation to a first rotational speed such that a first circumferential speed of the laundry drum at the first rotational speed is accelerated to and does not exceed approximately 3.7 m/s, whereby the laundry items adhere to an interior surface of the laundry drum as a result of induced centrifugal force, and a second control signal to the drive motor such that the drive motor, based on the second control signal received from the speed control device, rotates the laundry drum in a second direction of rotation, which is opposite to the first direction of rotation, to a second rotational speed, wherein a second circumferential speed of the laundry drum at the second rotational speed is less than about 1.0 m/s; and successively selecting, by the speed control device, a second phase during the washing and rinsing process and intermittently generating and sending:

a third control signal for the drive motor such that the drive motor, based on the third control signal received from the speed control device, accelerates the laundry drum in the first direction of rotation to a third rotational speed for high washing mechanics, wherein a third circumferential speed of the laundry drum at the third rotational speed for high washing mechanics lies in an interval of about 1.1 to 1.6 m/s, and a fourth control signal for the drive motor such that the drive motor, based on the fourth control signal received from the speed control device, accelerates the laundry drum in the second direction of rotation to a fourth rotational speed for high washing mechanics, wherein a fourth circumferential speed of the laundry drum at the fourth rotational speed for high washing mechanics lies in an interval of about 1.1 to 1.6 m/s.

2. The method according to claim 1, wherein a nominal value of the second rotational speed has a value at which falling items of laundry execute a rolling movement in a drum area of the laundry drum.

3. The method according to claim 2, wherein an acceleration of the laundry drum to the second rotational speed takes place immediately after the drum has come to a standstill.

4. The method according to claim 1, wherein the washing machine includes a device for monitoring at least one of foam formation and laundry imbalance, the drive of the laundry drum being interrupted when at least one of a specified limiting value for the foam formation is exceeded and imbalance occurs.

5. The method according to claim 1, wherein at least one of the rotational speeds, the respective acceleration to the rotational speeds, and the duration of the rotational speeds is varied as a function of measured values which specify at least one of the type and quantity of the laundry load.

6. The method according to claim 1, wherein at least one of the rotational speeds, the respective acceleration to the rotational speeds, and the duration of the rotational speeds is varied as a function of the selected washing program.

7. The method according to claim 1, wherein at least one of the duration of the first and second phases and the sequence of the first and second phases is varied as a function of measured values which specify at least one of the type and quantity of the laundry load.

8. The method according to claim 1, wherein at least one of the duration of the first and second phases and the sequence of the first and second phases is varied as a function of the selected washing program.

9. A method for washing laundry items in a washing machine including a laundry drum mounted for rotation and a drive motor intermittently driving the laundry drum during a washing and rinsing process in alternating directions of rotation, and a speed control device in communication with and controlling the drive motor of the laundry drum, the method comprising:

detecting a circumferential speed in m/s of the laundry drum using a speed sensor:

controlling, by the speed control device, the drive motor of the laundry drum based on the circumferential speed in m/s of the laundry drum detected by the speed sensor, the controlling including selecting a first phase during the washing and rinsing process and intermittently generating and sending a first control signal to the drive motor such that the drive motor, based on the first control signal received from the speed control device, accelerates the laundry drum in a first direction of rotation to a first rotational speed such that a first circumferential speed of the laundry drum at the first rotational speed is accelerated to and does not exceed approximately 3.7 m/s, and a second control signal to the drive motor such that the drive motor, based on the second control signal received from the speed control device, rotates the laundry drum in a second direction of rotation, which is opposite to the first direction of rotation, to a second rotational speed below the applicational rotational speed, wherein a second circumferential speed of the laundry drum at the second rotational speed is less than about 1.0 m/s; and successively selecting and sending, by the speed control device, a second phase during the washing and rinsing process and intermittently generating and sending a third control signal for the drive motor such that the drive motor, based on the third control signal received from the speed control device, accelerates the laundry drum in the first direction of rotation to a third rotational speed for high washing mechanics, wherein a third circumferential speed of the laundry drum at the third rotational speed for high washing mechanics lies in an interval of about 1.1 to 1.6 m/s, and a fourth control signal for the drive motor such that the drive motor, based on the fourth control signal received from the speed control device, accelerates the laundry drum in the second direction of rotation to a fourth rotational speed for high washing mechanics, wherein a fourth circumferential speed of the laundry drum at the fourth rotational speed for high washing mechanics lies in an interval of about 1.1 to 1.6 m/s, such that individual items of laundry are compressed and rub vigorously against one another, wherein the first speed is selected such that the laundry items can fall from a drum jacket during a subsequent reduction in the drum speed, a sufficiently large free area is formed in the laundry drum as a result of compression of the laundry items, and the detached exterior laundry items are permitted to roll into the free area when the laundry drum is accelerated in the opposite direction of rotation to the second rotational speed.

10. The method according to claim 9, wherein rotating the laundry drum in the first phase includes accelerating the laundry drum to the second rotational speed immediately after the drum has come to a standstill.

11. The method according to claim 9, wherein the washing machine includes a monitoring device for monitoring at least one of laundry imbalance and foam formation, the method further comprising:

interrupting the rotation of the laundry drum in response to the monitoring device detecting at least one of laundry imbalance and a specified limiting value of foam formation being exceeded.

12. The method according to claim 9, wherein at least one of the first rotational speed and the second rotational speed, the respective acceleration to the first rotational speed and the second rotational speed, a duration of the first rotational speed and the second rotational speed, a duration of the first phase and the second phase, and a sequence of the first phase and the second phase is variable as a function of measured values which specify at least one of a type and quantity of a laundry load.

13. A washing machine comprising:

a laundry drum for washing laundry items;

a drive motor intermittently driving the laundry drum during the washing and rinsing process in alternating directions of rotation;

a speed sensor that detects a circumferential speed in m/s of the laundry drum; and a speed control device, in communication with the speed sensor, that controls the drive motor of the laundry drum based on the circumferential speed in m/s of the laundry drum detected by the speed sensor, the speed control device programmed to execute the washing and rinsing process, the speed control device programmed to select a first phase, during the washing and rinsing process, and intermittently generate and send:

a first control signal to the drive motor such that the drive motor, based on the first control signal received from the speed control device, accelerates the laundry drum in a first direction of rotation to a first rotational speed such that a first circumferential speed of the laundry drum at the first rotational speed is accelerated to and does not exceed approximately 3.7 m/s, whereby the laundry items adhere to an interior surface of the laundry drum as a result of induced centrifugal force, and a second control signal to the drive motor such that the drive motor, based on the second control signal received from the speed control device, rotates the laundry drum in a second direction of rotation, which is opposite to the first direction of rotation, to a second rotational speed, wherein a second circumferential speed of the laundry drum at the second rotational speed is less than about 1.0 m/s, and the speed control device programmed to successively select a second phase, during the washing and rinsing process, and intermittently generate and send:

a third control signal to the drive motor such that the drive motor, based on the third control signal received from the speed control device, accelerates the laundry drum in the first direction of rotation to a third rotational speed for high washing mechanics, wherein a third circumferential speed of the laundry drum at the third rotational speed for high washing mechanics lies in an interval of about 1.1 to 1.6 m/s, and a fourth control signal to the drive motor such that the drive motor, based on the fourth control signal received from the speed control device, accelerates the laundry drum in the second direction of rotation to a fourth rotational speed for high washing mechanics, wherein a fourth circumferential speed of the laundry drum at the fourth rotational speed for high washing mechanics lies in an interval of about 1.1 to 1.6 m/s.

14. The washing machine according to claim 13, further comprising a device for establishing and evaluating at least one of foam formation inside the lye container and the developing laundry imbalance, wherein the speed control device is programmed to generate the first, second, third, and fourth control signals for the drive motor based on the at least one foam formation and developing laundry imbalance established and evaluated by the device, and when at least one of a specified foam and imbalance limit is exceeded, the drive motor is switched off by the control signals received from the speed control device.

15. The washing machine according to claim 13, wherein the speed control device is programmed to generate and send the first, second, third, and fourth control signals to the drive motor that vary at least one of a duration of the individual intervals, a duration of the phase, and a sequence of the first phase and the second phase of at least one of the washing and the rinsing process.

16. The washing machine according to claim 13, further comprising a device for establishing and evaluating at least one of a type and a quantity of the laundry items, wherein the speed control device is programmed to generate and send the first, second, third, and fourth control signals to the drive motor based on the at least one of the type and the quantity of the laundry items to be treated established and evaluated by the device.

17. The washing machine according to claim 13, further comprising:

a sensor that determines a laundry weight in the laundry drum and sends a signal to the speed control device representing the determined laundry weight, wherein the speed control device receives the signal from the sensor and is programmed to vary and send the first, second, third, and fourth control signals to the drive motor based on the received signal from the sensor.

18. The washing machine according to claim 13, further comprising:

a sensor that monitors an amount of foam formation inside the laundry drum and sends a signal to the speed control device representing the amount of foam formation, and wherein the speed control device receives the signal from the sensor and is programmed to vary and send the first, second, third, and fourth control signals to the drive motor based on the received signal from the sensor.

19. The washing machine according to claim 18, wherein the speed control device receives the signal from the sensor and is programmed to evaluate whether the amount of foam formation exceeds a specified amount of foam formation, and wherein the speed control device is programmed to send a signal to the drive motor to switch off the drive motor when the amount of foam formation exceeds the specified amount of foam formation.

20. The washing machine according to claim 13, further comprising:

a sensor that determines a variable value including one of a laundry load quantity, a type of laundry, a wash programme, a laundry imbalance, and a foam formation in the laundry drum, and sends a signal to the speed control device representing the variable value, and wherein the speed control device receives the signal from the sensor and is programmed to vary and send the first, second, third, and fourth control signals to the drive motor based on the received signal from the sensor.

21. A washing machine comprising:

a laundry drum for washing laundry items;

a drive motor intermittently driving the laundry drum during a washing and rinsing process in alternating directions of rotation, the laundry drum being rotated in a first phase, in which the laundry drum is accelerated in a first direction of rotation to a first rotational speed and in a second direction of rotation to a second rotational speed, the first direction of rotation being opposite to the second direction of rotation, wherein a circumferential speed of the laundry drum at the first rotational speed is accelerated to and does not exceed approximately 3.7 m/s whereby the laundry items adhere to an interior surface of the laundry drum as a result of induced centrifugal force, and at the second rotational speed less than about 1.0 m/s, the laundry drum being rotated in a second phase within at least one of the washing and rinsing process, in which the laundry drum is accelerated in the second phase in both directions of rotation wherein the circumferential speed of the laundry drum in the second phase is in an interval of about 1.1 to 1.6 m/s and that the first and second phases take place successively at least once during at least one of the washing and rinsing process;

a speed sensor that detects a circumferential speed in m/s of the laundry drum; and means, in communication with the speed sensor, for controlling the drive motor of the laundry drum based on the circumferential speed in m/s of the laundry drum detected by the speed sensor, the means for controlling programmed to execute the washing and rinsing process, the means for controlling programmed to generate and send control signals to the drive motor such that the drive motor, based on the control signals received from the means for controlling, intermittently drives the laundry drum in the first phase in which the laundry drum is accelerated in the first direction of rotation to the first rotational speed of approximately 3.7 m/s and in the second direction of rotation to the second rotational speed of less than about 1.0 m/s.

22. The washing machine according to claim 21, wherein the means for controlling generates and sends control signals to the drive motor such that the drive motor, based on the control signals received from the means for controlling, intermittently drives the laundry drum in the second phase in which the laundry drum is accelerated in both directions of rotation at the speed for high washing mechanics, which lies in the interval of about 1.1 to 1.6 m/s.

* * * * *